US009511580B2

(12) United States Patent
Xue et al.

(10) Patent No.: US 9,511,580 B2
(45) Date of Patent: Dec. 6, 2016

(54) FIXTURE FOR STATION-TRANSFERRING WHEEL PRINTING

(71) Applicant: CITIC Dicastal CO., LTD, Qinhuangdao (CN)

(72) Inventors: Bowen Xue, Qinhuangdao (CN); Guangcai Chen, Qinhuangdao (CN); Jiandong Guo, Qinhuangdao (CN); Yongning Wang, Qinhuangdao (CN); Zhihua Zhu, Qinhuangdao (CN); Changhai Li, Qinhuangdao (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 0 days.

(21) Appl. No.: 15/043,077

(22) Filed: Feb. 12, 2016

(65) Prior Publication Data

US 2016/0236459 A1 Aug. 18, 2016

(30) Foreign Application Priority Data

Feb. 16, 2015 (CN) ..... 2015 1 0086268

(51) Int. Cl.

| | |
|---|---|
| ***B41F 17/00*** | (2006.01) |
| ***B41F 17/30*** | (2006.01) |
| ***B41F 3/54*** | (2006.01) |
| ***B41F 17/24*** | (2006.01) |
| ***B41F 17/16*** | (2006.01) |
| ***B41F 17/14*** | (2006.01) |

(52) U.S. Cl.

CPC ..... *B41F 3/54* (2013.01); *B41F 17/001* (2013.01); *B41F 17/002* (2013.01); *B41F 17/006* (2013.01); *B41F 17/14* (2013.01); *B41F 17/16* (2013.01); *B41F 17/24* (2013.01); *B41F 17/30* (2013.01)

(58) Field of Classification Search

CPC ..... B41F 17/001; B41F 17/002; B41F 17/006; B41F 17/14; B41F 17/16; B41F 17/24; B41F 17/30

USPC ..... 101/41, 50, 163

See application file for complete search history.

(56) References Cited

U.S. PATENT DOCUMENTS

| | | | | |
|---|---|---|---|---|
| 6,568,320 B2 * | 5/2003 | Wada | B41F 16/008 | 101/35 |
| 2015/0165830 A1 * | 6/2015 | Hajikano | B41J 3/4073 | 347/20 |

FOREIGN PATENT DOCUMENTS

| | | | | |
|---|---|---|---|---|
| JP | 10329402 | * | 6/1997 | B41M 1/40 |
| WO | 2015/135252 | * | 9/2015 | B41F 17/08 |

* cited by examiner

*Primary Examiner* — Jill Culler
*Assistant Examiner* — Marissa Ferguson Samreth
(74) *Attorney, Agent, or Firm* — Hamre, Schumann, Mueller & Larson, P.C.

(57) ABSTRACT

The present invention relates to a fixture for station-transferring wheel printing, which is composed of stands, servo motors, rotating plates, slide sleeves, air cylinders and the like. When in use, the fixture provided by the present invention can meet the requirement for quickly printing a pattern on a fixed window of a wheel and improve the production efficiency effectively, and meanwhile has the characteristics of simple mechanism, high automation degree, advanced technology, safe and stable performance.

2 Claims, 3 Drawing Sheets

FIXTURE FOR STATION-TRANSFERRING WHEEL PRINTING

FIELD OF THE INVENTION

The present invention relates to a fixture, and in particular to a fixture for station-transferring wheel printing.

BACKGROUND OF THE INVENTION

With the continuous improvement of the technology for manufacturing aluminum alloy wheels, customers put forward higher demands on the appearance effect constantly. One is to print a LOGO pattern on the front face of the wheel. As the wheel windows are large in quantity and show no difference, a traditional printing method is that a worker places the wheels on the fixing fixture one by one and then adjusts the angle for printing. This method is not only extremely low in efficiency, but also very inconvenient for operation. The present invention throughly solves the above problem and realizes the automatic turnover of the wheel, with loading/unloading occupying no tact time in production.

SUMMARY OF THE INVENTION

An object of the present invention is to provide a fixture for station-transferring wheel printing, which can meet the requirement for quickly printing a pattern on a fixed window of a wheel.

In order to achieve the object described above, a technical solution of the present invention is as follows: a fixture for station-transferring wheel printing is composed of a stand, a servo motor, a platform, a bearing seat, a shaft, a rotating plate, a guide rail, a slide block, an air cylinder, a connecting rod, a press head, a turning plate, a pad printing head, a positioning flange, a floating column, a slide sleeve, a spring and a positioning block. The platform above which the bearing seat is mounted is fixed above the stand; the shaft above which the rotating plate is mounted is fixed inside the bearing seat through the bearing; and an output end of the servo motor fixed below the platform is connected with the shaft.

The slide block is fixed above the rotating plate through the guide rail; the turning plate above which the positioning block and the press head are fixed is hinged with the rotating plate; two ends of the connecting rod are respectively hinged with a downside of the turning plate and the slide block; an output end of the air cylinder fixed above the rotating plate is connected with the slide block; the slide sleeve is fixed above the turning plate, and the floating column above which the positioning flange is fixed is matched with the slide sleeve; the spring is fixed below the floating column; a station of the fixture comprises the items described above, and the fixture is composed of 2 or 4 stations.

During actual use, a wheel is placed on the positioning flange at one of the stations and is pressed down, the spring is compressed, and when coming into contact with the positioning block, a lower edge of the wheel is tightly pressed and fixed with the press head; the servo motor drives the rotating plate, the wheel and the like to rotate by 90 degrees or 180 degrees through the shaft; when the wheel is transferred to a position below the pad printing head, the air cylinder drives the slide block to move rightwards through the guide rail; the turning plate and the wheel are rotated by a certain degree under the action of the connecting rod; at the moment, the pad printing head moves downwards to print a fixed pattern onto a front face of the wheel.

When in use, the fixture provided by the present invention can meet the requirement for quickly printing a pattern on a fixed window of a wheel and improve the production efficiency effectively, and meanwhile has the characteristics of simple mechanism, high automation degree, advanced technology, safe and stable performance.

Figure 1:
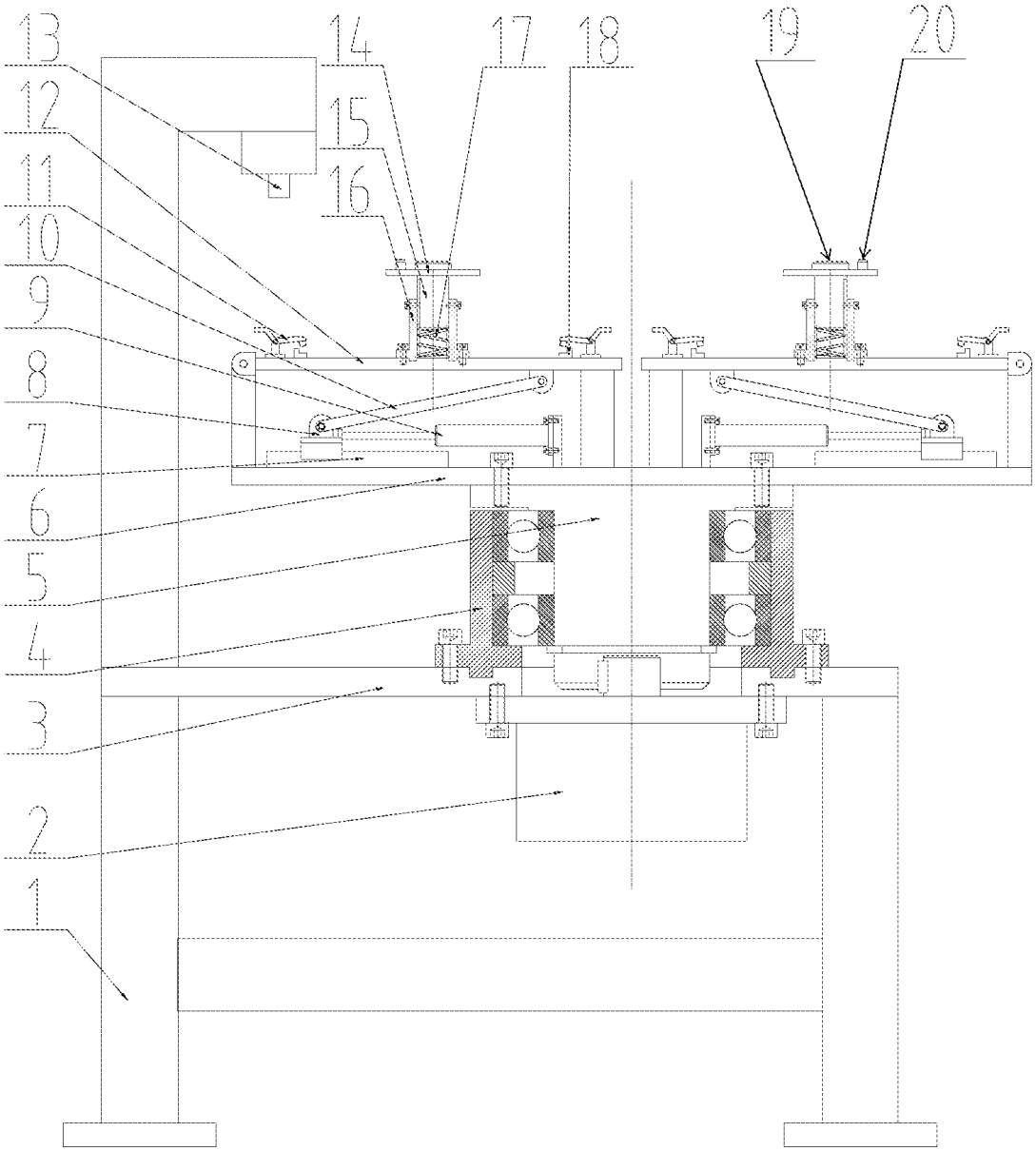
FIG. 1 is a front view of a fixture for station-transferring wheel printing.
Figure 2:
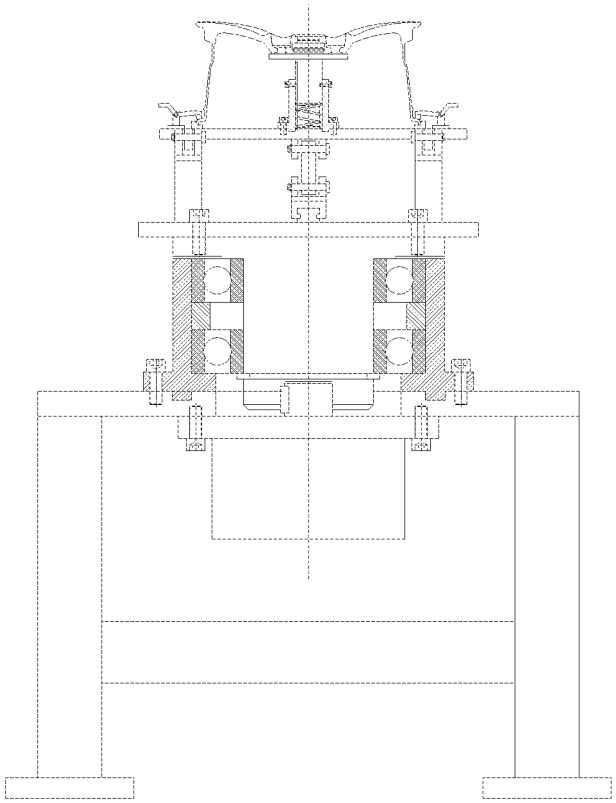
FIG. 2 is a left view of a fixture for station-transferring wheel printing.
Figure 3:
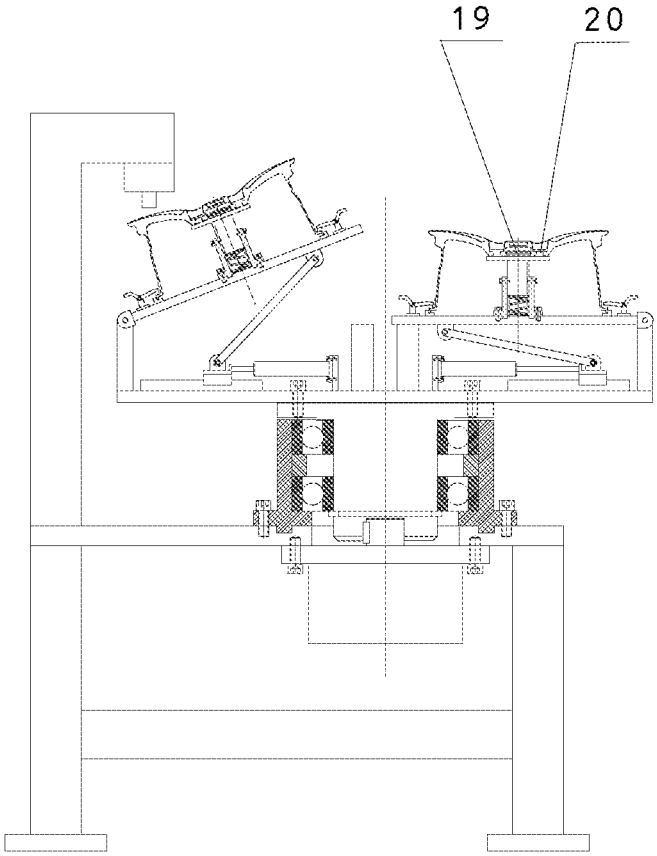
FIG. 3 is a front view of a fixture for station-transferring wheel printing during working.

In the drawings, the numeric symbols are as follows: 1—stand, 2—servo motor, 3—platform, 4—bearing seat, 5—shaft, 6—rotating plate, 7—guide rail, 8—slide block, 9—air cylinder, 10—connecting rod, 11—press head, 12—turning plate, 13—pad printing head, 14—positioning flange, 15—floating column, 16—slide sleeve, 17—spring, 18—positioning block, 19—center shaft and 20—positioning column.

DETAILED DESCRIPTION OF THE INVENTION

In the following, the details and working conditions of a specific device provided by the present invention are described in combination with the figures.

The fixture is composed of a stand 1, a servo motor 2, a platform 3, a bearing seat 4, a shaft 5, a rotating plate 6, a guide rail 7, a slide block 8, an air cylinder 9, a connecting rod 10, a press head 11, a turning plate 12, a pad printing head 13, a positioning flange 14, a floating column 15, a slide sleeve 16, a spring 17 and a positioning block 18. The platform 3 above which the bearing seat 4 is mounted is fixed above the stand 1; the shaft 5 above which the rotating plate 6 is mounted is fixed inside the bearing seat 4 through the bearing; an output end of the servo motor 2 fixed below the platform 3 is connected with the shaft 5.

The slide block 8 is fixed above the rotating plate 6 through the guide rail 7; the turning plate 12 above which the positioning block 18 and the press head 11 are fixed is hinged with the rotating plate 6; two ends of the connecting rod 10 are respectively hinged with a downside of the turning plate 12 and the slide block 8; an output end of the air cylinder 9 fixed on the rotating plate 6 is connected with the slide block 8; the slide sleeve 16 is fixed above the turning plate 12, and the floating column 15 above which the positioning flange 14 is fixed is matched with the slide sleeve 16; the spring 17 is fixed below the floating column 15; a station of a fixture comprises the items described above, and the fixture is composed of 2 or 4 stations.

In a working process, a wheel is placed on the positioning flange 14 at one of the stations and is pressed down, such that the center hole of the wheel engages the center shaft 19 and a bolt hole of the wheel engages with the positioning column 20, the spring 17 is compressed, and when coming into contact with the positioning block 18, a lower edge of the wheel is tightly pressed and fixed with the press head 11; the servo motor 2 drives the rotating plate 6, the wheel and the like to rotate by 90 degrees or 180 degrees through the shaft 5; when the wheel is transferred to a position below the pad printing head 13, the air cylinder 9 drives the slide block

8 to move rightwards through the guide rail 7; the turning plate 12 and the wheel are rotated by a certain degree under the action of the connecting rod 10; at the moment, the pad printing head 13 moves downwards to print a fixed pattern onto a front face of the wheel.

The invention claimed is:

1. A fixture for printing on at least one wheel, comprising a stand including a platform for holding the at least one wheel and a pad printing head fixed on the stand above the platform, the platform supporting a servo motor, a bearing seat and a shaft, wherein the servo motor is provided fixed below the platform and the bearing seat and shaft are mounted on and above the platform, an output end of the servo motor is connected with the shaft and the shaft is fixed inside the bearing seat via a bearing; a rotating plate fixed to and mounted above the shaft, the servo motor driving the rotating plate to rotate via the shaft, the rotating plate defining 2 or 4 stations, each station supporting a wheel for printing and further comprising a turning plate fixed above the rotating plate via a guide rail, a slide block, an air cylinder, and a connecting rod; the slide block being fixed above the rotating plate through the guide rail, the connecting rod having two ends, one end of the connecting rod being hinged to the slide block and the other end of the connecting rod being hinged with a lower surface of the turning plate and an output end of the air cylinder being fixed on the rotating plate and connected with the slide block such that the air cylinder drives the slide block to move through the guide rail and results in the turning plate and the wheel to be rotated by a certain degree under the action of the connecting rod;

the turning plate further comprising a positioning flange, a floating column, a slide sleeve, and a spring and at least one press head and positioning block pair; the at least one press head and positioning block pair are fixed on the turning plate and are hinged with the rotating plate; the slide sleeve is fixed on and above the turning plate, and the floating column is mounted in the slide sleeve and with the positioning flange on and above the floating column; and the spring is fixed below the floating column;

wherein when the wheel is placed on the positioning flange at one of the stations, the wheel is positioned and secured on the turning plate via the at least one press head and positioning block pair, the servo motor drives the rotating plate and the wheel via the shaft to a position below the pad printing head, the turning plate is driven via the air cylinder to rotate the wheel by a certain degree and the pad printing head moves to print a pattern onto the wheel.

2. The fixture of claim 1, wherein the positioning flange further comprises a positioning column configured to engage with a bolt hole of the wheel and a center shaft is configured to engage with a center hole of the wheel when the wheel is placed on the positioning flange.

* * * * *